United States Patent [19]

Devanney

[11] 3,984,004

[45] Oct. 5, 1976

[54] DISPLAY ASSEMBLY AND METHOD FOR CONSTRUCTING SAME

[75] Inventor: Raymond H. Devanney, Winsted, Conn.

[73] Assignee: Vanco, Inc., Collinsville, Conn.

[22] Filed: Dec. 3, 1975

[21] Appl. No.: 637,215

[52] U.S. Cl. ..... 211/133; 211/71; 312/126

[51] Int. Cl.[2] ..... A47F 7/00

[58] Field of Search ..... 211/133, 34, 35, 37, 211/71, 72, 74, 75, 77, 78, 88; 312/126, 128, 245

[56] References Cited

UNITED STATES PATENTS

| | | | |
|---|---|---|---|
| 723,964 | 3/1903 | Wilson | 312/245 X |
| 938,809 | 11/1909 | Alexander et al. | 211/77 X |
| 1,408,370 | 2/1922 | Lincoln | 312/245 |
| 2,740,546 | 4/1956 | Kowalski | 211/71 X |
| 2,880,046 | 3/1959 | Black | 211/71 |

FOREIGN PATENTS OR APPLICATIONS

| | | | |
|---|---|---|---|
| 6,801,692 | 8/1968 | Netherlands | 211/74 |

*Primary Examiner*—James T. McCall
*Assistant Examiner*—Robert W. Gibson, Jr.

[57] ABSTRACT

A display and storage assembly has an arcuate front face with openings therein to a multiplicity of tubular container members for receiving, storing and displaying goods. The assembly includes a plurality of vertically spaced body members having arcuate edge surfaces about which is formed the arcuate front cover member. A flexible sheet material back support member also extends in an arcuate configuration in spaced relationship to the cover member and is provided with apertures aligned with those of the cover member. The tubular container members are supported between the cover member and back support member and have a front rim element with a tubular body portion extending through the aperture of the cover member into telescoping engagement with a tubular body element, while a flange or rim portion abuts and is engaged with the outer surface of the cover member.

19 Claims, 11 Drawing Figures

DISPLAY ASSEMBLY AND METHOD FOR CONSTRUCTING SAME

BACKGROUND OF THE INVENTION

Over the years, many structures have been designed for displaying and storing elements of merchandise and a great deal of emphasis has been given in recent years to point-of-purchase displays. It has long been considered desirable to have display units which would permit segregation of goods being displayed by size, color, or other appropriate criteria and to allow marking of adjacent areas with the data identifying the criteria appropriate to the goods stored in a given portion of the display.

Recently, there was developed an attractive and well-received display assembly providing an arcuate front face having access to a multiplicity of cylindrical containers in each of which there could be placed a pair of shoes or the like segregated by appropriate criteria such as size, etc. Although the design concept was highly successful, the method of construction and assembly for this display unit presented significant problems from the standpoints of manufacturing, assembly and cost.

It is an object of the present invention to provide a novel display and storage assembly utilizing an arcuate front face upon which there are mounted in secure engagement a multiplicity of tubular containers.

It is also an object to provide such a display and storage assembly wherein the tubular container members are secured firmly adjacent both ends thereof.

Another object is to provide such a display and storage assembly wherein the vertical edges of an arcuate cover member and adjacent frame structure are attractively concealed within a vertical molding member.

Still another object is to provide a novel method for making such a display and storage assembly wherein the several components may be readily assembled to ensure firm and proper engagement thereof.

A further object is to provide such a method for making a display and storage assembly in which various components may be assembled readily and secured by adhesive engagement and cooperate to provide structural rigidity.

A still further object is to provide such a method for making a display and storage assembly wherein various components may be readily fabricated from relatively low cost sheet materials or molded from synthetic resin in relatively simple configurations which may then be readily assembled.

SUMMARY OF THE INVENTION

It has now been found that the foregoing and related objects can be readily attained in a display and storage assembly wherein a plurality of body members are vertically spaced apart and each has an arcuate edge surface. A flexible sheet material cover member extends in an arcuate configuration about the arcuate edge surfaces of the body members and is provided with a multiplicity of apertures spaced thereabout, and it is secured to the body members by suitable means. Spaced rearwardly of the cover member is a flexible sheet material back support member extending in an arcuate configuration. The arc of said support member is of lesser radius than that of the cover member to maintain substantially uniform spacing therebetween and from the arcuate edges of the body members. The back support member is supported by the body members and has apertures therein aligned with the apertures of the cover member. A multiplicity of container members extends between and is supported in the apertures of the cover and back support members, and each container member has a tubular body element extending between the cover and back support members and a front rim element with a tubular body portion extending through an aperture of the cover member into telescoping engagement with the body element and a peripheral flange portion abutting the outer surface of the cover member. A rear wall element on the inner end of the body element has a portion projecting therefrom which seats in the cooperating aperture of the back support member. This assembly thus provides a multiplicity of container members each defining a storage compartment open through the apertures of the cover member for storage and display of goods.

In the preferred embodiment, there is included a plurality of vertical members extending between the body members and means securing the body members and vertical members in assembly to provide a frame. Desirably, two of the vertical members are disposed at the ends of the arcuate edge surface of the body members, and vertically extending molding members enclose the adjacent surfaces of the cover member and the vertical members. Preferably, a back sheet member extends across the surface of the body members between the ends of the arcuate edge surfaces thereof and the ends of the cover member. The molding members are desirably integrally formed to provide a plurality of recesses seating the edges of the cover member and the back sheet member.

In a highly functional embodiment, there are three spaced body members with two body members being adjacent the upper and lower edges of the cover member and one body member being intermediate the first two body members. The apertures of the cover member are disposed in the portion thereof extending between the upper and intermediate body members, and the back support member is disposed between the upper and intermediate support members.

Desirably, the container members are of circular cross section and the apertures of the cover member are of cooperating circular configuration so as to snugly seat the body elements of the container members. The apertures in the back support member are coaxially aligned with the apertures of the cover member, and the projecting portions on the rear wall elements of the container members are coaxial bosses. Locking members engage the projecting portions or bosses which extend through the back support member to retain them in assembly therewith. The rear wall element desirably includes an end wall portion and a cylindrical body portion telescopically engaged with the body element of the container member. The front rim element and the rear wall element are adhesively engaged with the body element, and the front rim elements of the container members are adhesively engaged with the front surface of the cover member.

In one embodiment, a cap member has the configuration of a segment of a sphere and is disposed above the cover member and the uppermost of the body members, and means is provided to secure the cap member in assembly with the uppermost body member.

In making the display and storage assembly, a plurality of horizontally extending support members are assembled in vertically spaced relationship and have aligned arcuate edges to form a frame. A multiplicity of apertures are formed in a length of self-supporting flexible sheet material, and there are secured in these apertures rim elements each having a tubular body portion extending through the apertures and projecting therebeyond and a peripheral flange portion abutting the one surface of the sheet material. The sheet material is formed about the arcuate edge of the frame to provide an arcuate front cover with the flange portions of the rim elements disposed on the outer surface thereof, and the front cover is secured to the frame in the arcuate configuration. The tubular body elements are engaged on the inwardly projecting body portions of the rim elements to form tubular container members, and a second length of flexible sheet material is formed into a cooperating arcuate configuration and it is provided with apertures therein aligned with the apertures of the front cover and with the container members. As it is formed into the arcuate configuration, projections on the inner ends of the container members are inserted into the apertures thereof and thereafter the second length of sheet material is secured in the arcuate configuration.

Preferably, the rim elements are secured to the front cover by effecting adhesive engagement between at least the flange portions thereof and the outer surface of the front cover. The tubular body elements are engaged on the body portions of the rim elements by effecting adhesive engagement between telescoping portions of the body portions and body elements.

Preferably, locking elements are applied on the projecting portions at the inner ends of the container members which extend through the apertures in the second length of flexible material.

DETAILED DESCRIPTION OF THE ILLUSTRATED EMBODIMENT

Turning now to the attached drawings in detail, therein illustrated is a display and storage assembly embodying the present invention wherein a front cover sheet generally designated by the numeral 10 has an arcuate cross section and has mounted therein a multiplicity of container members generally designated by the numeral 12, which are spaced about a substantial portion of the surface thereof. A cap or dome having the configuration of a segment of a sphere and generally designated by the numeral 14 is disposed upon the upper portion of the frame assembly generally designated by the numeral 16 and best seen in FIG. 4.

Figure 4:
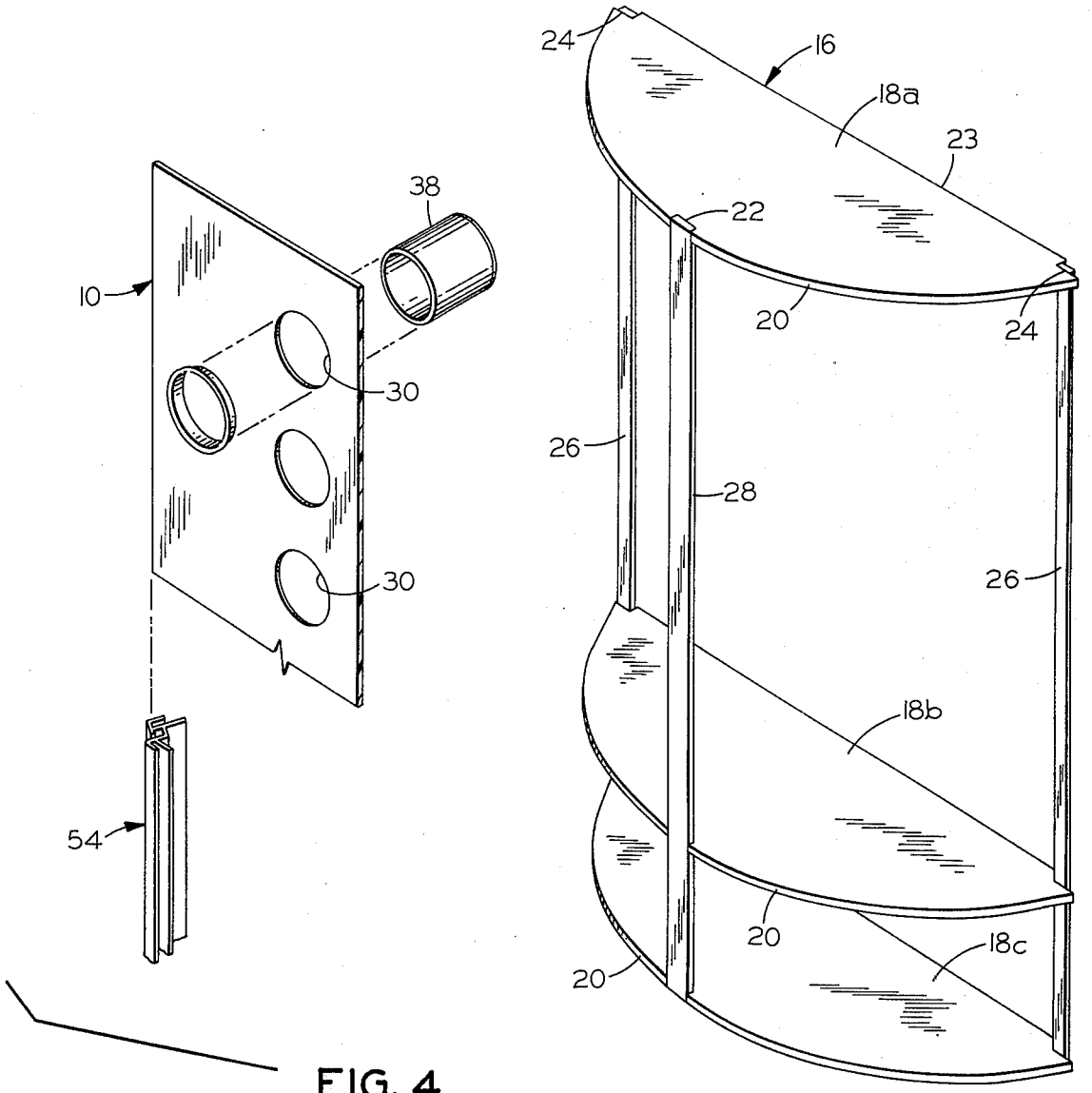
FIG. 4 is a fragmentary, partially exploded view thereof.

Turning to the construction of the frame assembly 16 in detail as seen in FIG. 4, there which are three vertical spaced body members or shelves, 18*a*, 18*b*, 18*c*, each having an arcuate front edge 20 with a notch 22 adjacent the midpoint thereof and a generally rectilinear rear edge 23 with notches 24 at the ends thereof. Vertical members or slats 28 are seated in the notches 22,24 and are secured thereto by staples or other suitable means (not shown).

Figure 5:
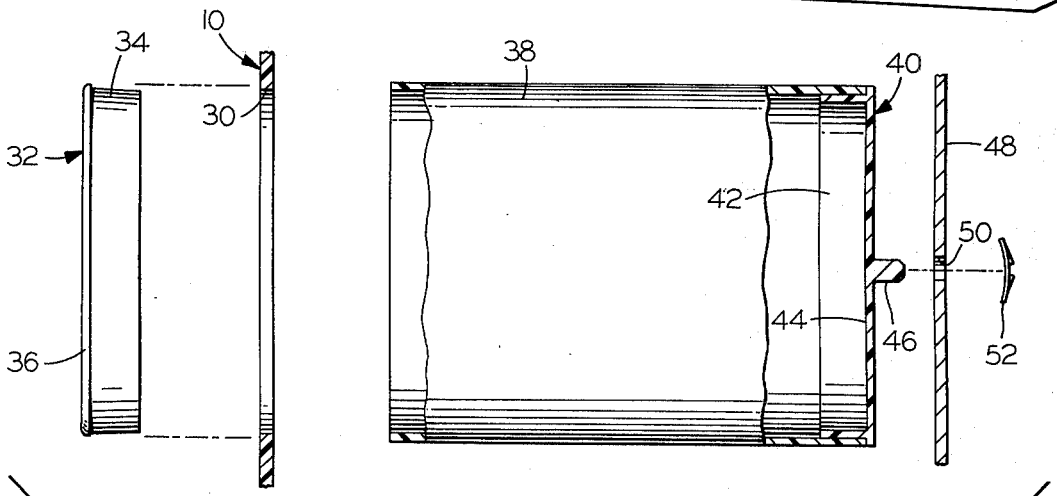
FIG. 5 is a partially exploded view of the container member and portions of the front cover and back support member.

As also seen in FIG. 4, the flexible front cover sheet 10 has circular apertures 30 therein whichare arranged in columns and rows. As best seen in FIG. 5, the container members 12 which are seated in the apertures 30 of the front cover sheet 10 each include a rim element generally designated by the numeral 32 which has a cylindrical tubular body portion 34 extending through the apertures 30 and behind the front cover sheet 10 and a peripheral flange portion 36 which abuts the front surface of the front cover sheet 10. The cylindrical tubular body element 38 telescopically engages over the body portion 34 of the rim element 32 and is adhesively engaged therewith. A rear wall element generally designated by the numeral 40 includes a tubular cylindrical body portion 42 telescopically engaged with the opposite end of the body element 38 and a rear wall portion 44 sealing the rear of the container member 12 and providing a peripheral flange abutting the edge of the tubular body element 38. Coaxially formed on the outer surface of the rear wall portion 44 is an outwardly projecting cylindrical boss 46.

Figure 1:
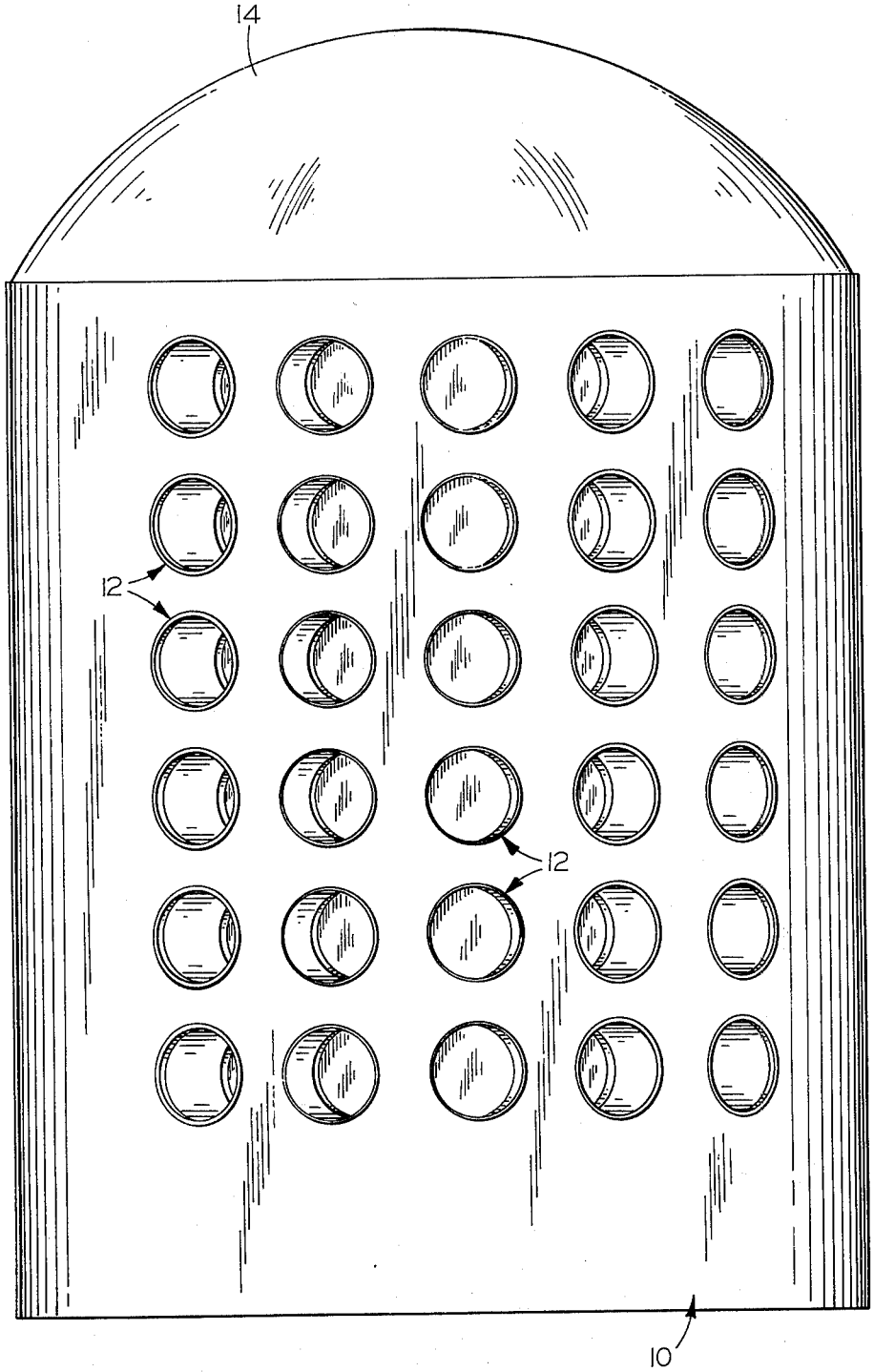
FIG. 1 is a front elevational view of a shoe display and storage assembly embodying the present invention.
Figure 2:
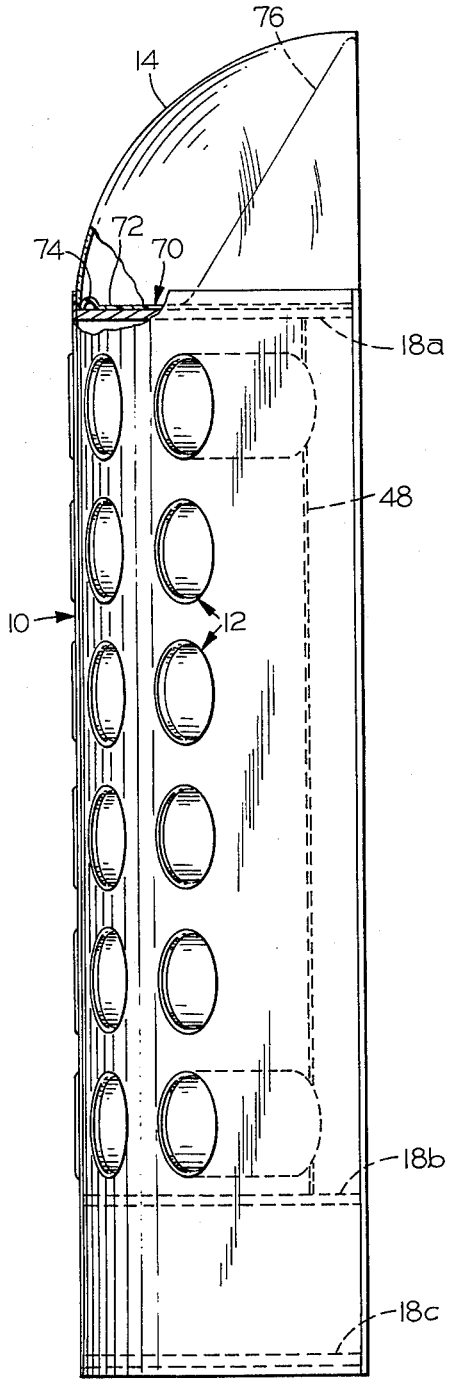
FIG. 2 is a side elevational view thereof with a portion broken away to reveal internal construction and with other parts shown in dotted line.
Figure 3:
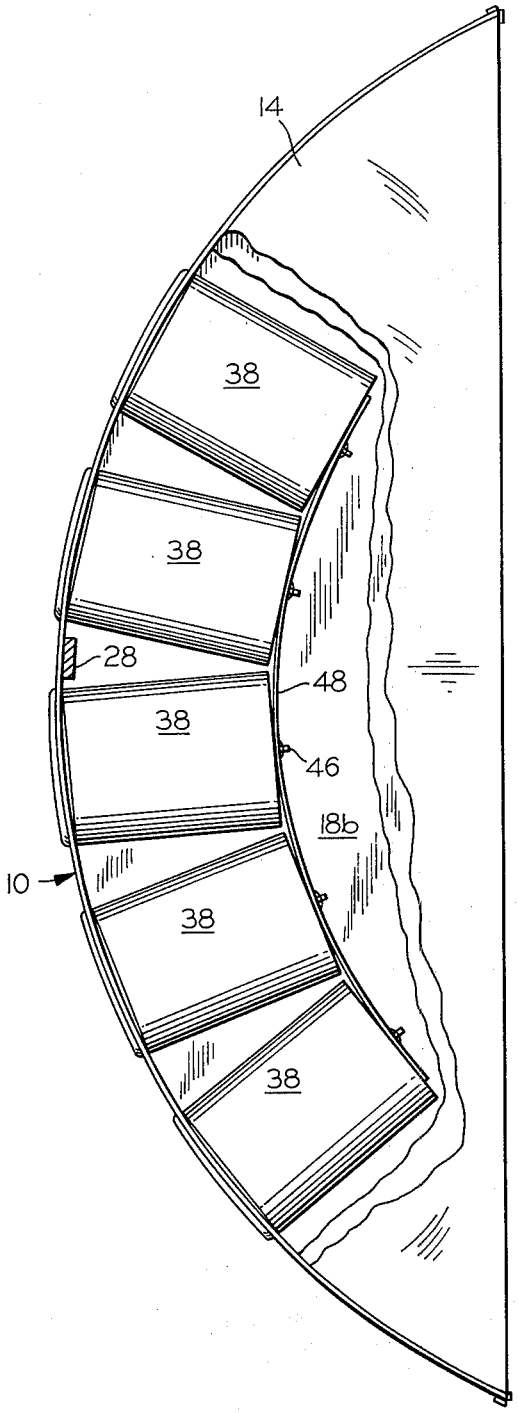
FIG. 3 is a plan view thereof to a enlarged scale with portions thereof broken away to reveal internal construction.

As best seen in FIGS. 2 and 3, a back support member 48 of flexible sheet material is formed into an arcuate configuration and disposed between the shelves 18*a* and 18*b* It has a multiplicity of apertures 50 therein which are coaxially aligned with the apertures 30 of the front cover sheet 10 and through which extend the bosses 46 on the container members 12 as best seen in FIG. 5. Locking clips 52 are snapped over the bosses 46 projecting through the back support member 48 and thus serve to maintain the container members in assembly with the back support member 48 are well as the arcuate configuration of the back support member 48.

Figure 10:
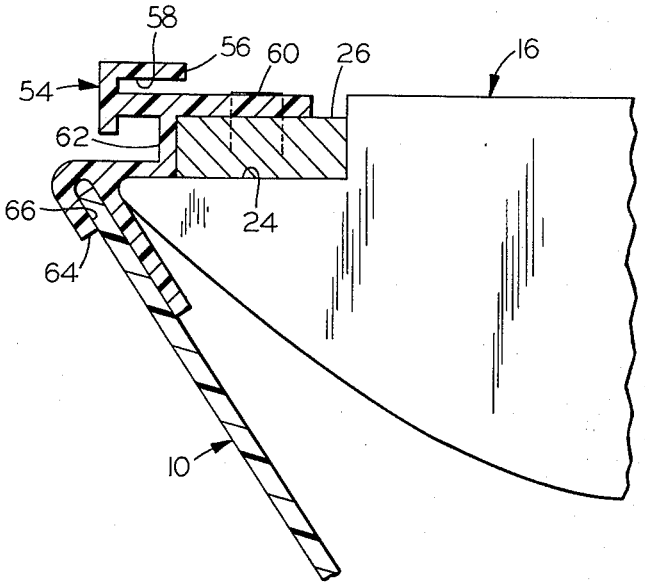
FIG. 10 is a fragmentary sectional view at one end of the arcuate section showing the elements partially assembled and prior to forming the cover member about the arcuate edge of the frame.
Figure 11:
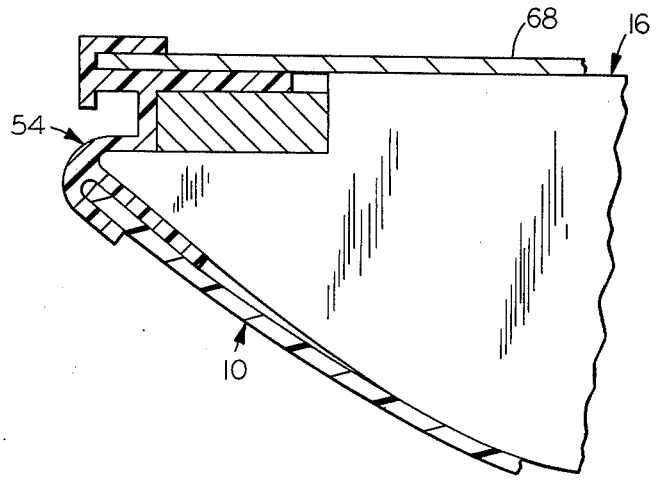
FIG. 11 is a similar view showing the front cover member formed into its arcuate configuration and further showing the back cover member inserted in its finished position.

As best seen in FIGS. 10 and 11, a pair of integrally formed synthetic resin molding strips generally designated by the numeral 54 extend vertically along the slats 26 and have a rearward portion 56 of generally J-shaped cross section providing an inwardly opening recess 58. The inner leg of the rearward portion 56 is secured to the slat 26 by staples 60. Extending from the rearward portion 56 is a web portion 62 of generally L-shaped configuration which conforms closely to the thickness of the slat 26. At the opposite end of the web portion 62 is a forward portion 64 of generally J-shaped cross section providing an inwardly opening recess 66 in which is seated the edge of the front cover sheet 10. A back cover sheet 68 extends across the rearward surface of the frame assembly 16 and has its vertical side edges engaged within the inwardly opening recesses 58 of the molding strips 54. As can be seen, the back cover sheet 68 covers the entire surface of the frame assembly 16 and projects thereabove to a point closely adjacent the rearward edge of the dome 14.

Seated upon the top surface of the uppermost body member 18*a* is the dome support member generally designated by the numeral 70 which has a flat portion 72 adjacent the arcuate edge 20 of the body member 18*a*. This flat portion 72 has an arcuate configuration generally conforming to that of the forwardmost portion of the body member 18*a* and is provided with a series of raised dimples or ribs 74 at its forward edge which cooperate with a portion of the front cover sheet 10 projecting above the top surface of the uppermost body member 18*a* to provide a channel for gripping the lower edge of the dome 14. The dome support member 70 also has a rearwardly upwardly extending portion 76 with a reversely bent lip at the upper end thereof which fits over the upper edge of the back cover sheet 68. As best seen in FIG. 2, the dome 14 is removably seated at its forward base in the channel defined by the dimples 74 and front cover sheet 10 and its upper and rearward portion rests upon the upper edge of the dome support sheet 70.

Turning now to the method of assembling the structure of the illustrated embodiment, initially the frame assembly 16 is constructed by assembling the several shelves 18 in vertically spaced relationship together with the slats 24,26. The several components are maintained in assembly by staples, nails or like fasteners and the bond may be augumented by use of adhesives if so desired.

Figure 6:
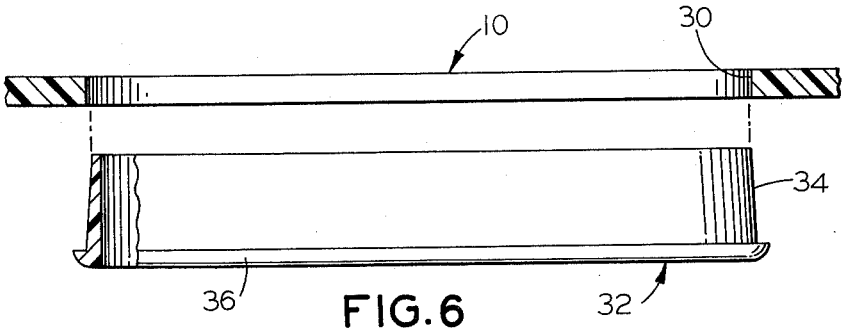
FIGS. 6–9 are views illustrating the assembly of container member to a fragmentarily illustrated front cover member.
Figure 7:
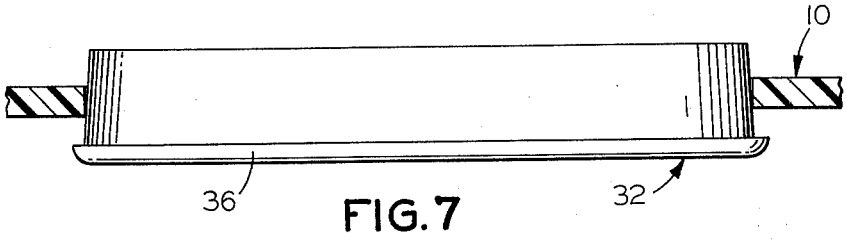

The front cover sheet 10 is provided with the rows and columns of apertures 30 in the desired location and then supported above a table or like planar surface. The rim elements 32 are then inserted into the apertures 30 as seen in FIGS. 6 and 7 of the attached drawings.

Figure 8:
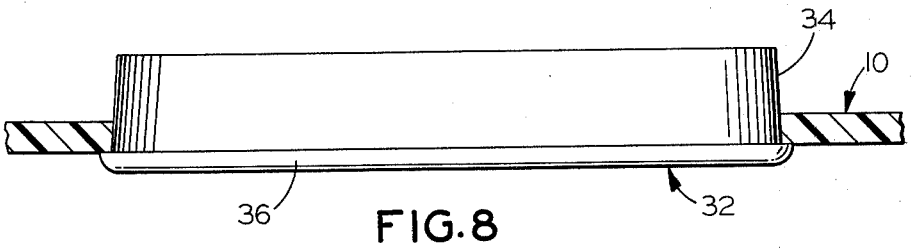

In the preferred embodiment, the rim elements 32 and front cover sheet 10 are made of a thermoplastic resin so that bonding thereof may be effected simply by applying a solvent adhesive to the surface of the body portion 34 which will then wick into the mating surfaces of the two components. A cylindrical tool is then used to bear upon the back surface of the front cover sheet 10 and apply pressure while the adhesive produces bonding of the surfaces to produce the subassembly shown in FIG. 8 of the attached drawings.

After the several rim elements 32 have been assembled to the front cover sheet 10 in the fashion indicated, the vertical edges of the front cover sheet 10 are inserted into the recesses 66 of the molding strips 54 as seen in FIG. 10 and secured thereto by adhesive. The cover sheet 10 is then bent into its arcuate configuration about the arcuate edges 20 of the frame assembly 16 and the molding strips 54 are secured to the rear slats 24 by staples 60 or the like. The resultant bowed configuration of the front cover sheet 10 as assembled is seen in FIG. 11.

Figure 9:
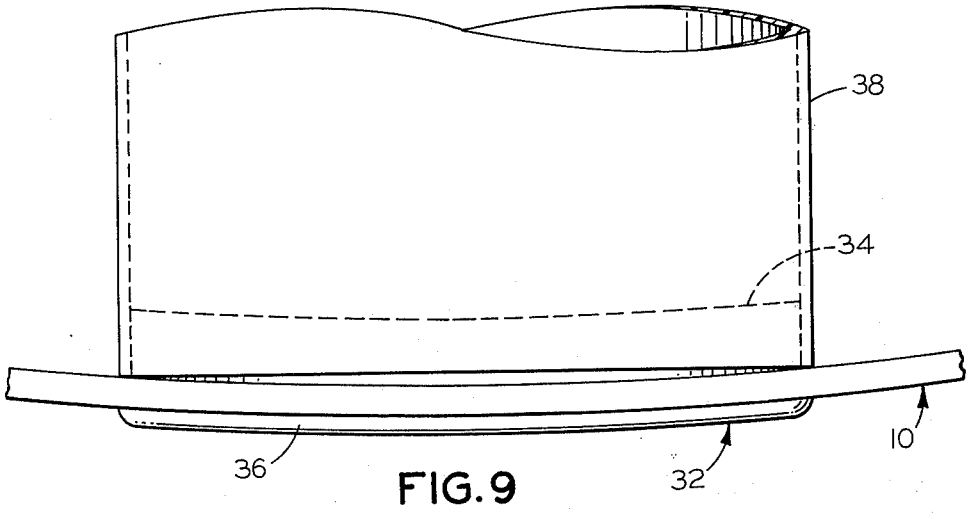

In the next stage of assembly, the rear wall elements 40 are assembled to the body elements 38 of the container members, again by a solvent adhesive applied to the interface between the telescoping portions. The cup-shaped structure which is thus defined has applied thereto a solvent adhesive along the inner surface of the forward portion or open end of the body element 38, and this is then telescopingly fitted over the inwardly projecting body portion 34 of the rim element 32 which has already been mounted upon the front cover sheet 10. Pressure is applied to ensure a firm bond of the body element 38 upon the rim element 32, and the resultant structure is as seen in FIG. 9.

Following assembly of the container members 12 to the front cover sheet 10, the back support member 48 which has previously been provided with small apertures 50 is bowed into an arc and snapped over the bosses 46 on the container members 12. It is locked into assembly with the container members 12 by snapping onto projecting portions of the bosses 47 the locking clips 52, and it derives its vertical support by its snug fit between the body members 18*a*,18*b*.

One edge of the back cover sheet 68 is inserted into the recess 58 of one molding strip 54 and the back cover sheet 68 is then bowed sufficiently to enable insertion of the other vertical edge into the recess 58 of the other molding strip 54. The top support member 70 is then assembled upon the upper surface of the body member 18*a* and is secured thereto by staples, nails or the like passing through its flat portion 72. As previously indicated, the reversely bent lip at the upper end of the diagonal portion 76 fits over the upper edge of the back cover sheet 68.

Lastly, the dome 14 is disengagably assembled by pressing its forward lower edge into the channel between the dimples 74 of the top support member 70 and the upper edge of the front cover sheet 10 and allowing its rearward portion to rest upon the dome support member 70.

In using the assembly of the present invention, suitable indicia are provided upon the surface of the front cover sheet 10 and, if desired, the dome 14. The articles to be displayed and stored are inserted into the container members 12 through the openings in the front cover sheet 10. For example, in the display of shoes and the like, the indicia along one vertical edge may comprise shoe sizes and the articles disposed in the container members 12 of a row corresponding with a size indicium will be different styles and colors of shoes of that size. The indicia may be of the type utilizing ever tacky adhesive so that they may be removed and interchanged from time to time. Suitable promotional legends may also be affixed to the surface of the display unit.

The several components of the assembly may be readily fabricated from materials which permit relative economy commensurate with durability. For example, the body members or shelves 18 are conveniently formed from particle board or plywood and the slats are conveniently wood members; however, synthetic plastic elements and metal may also be employed if so desired.

To facilitate assembly and provide a durable attractive appearance, the front cover sheet 10 is most desirably fabricated from a high gloss synthetic resin sheet material providing the desired flexibility such as acrylonitrile/styrene/butadiene (ABS) although various other resins may also be employed which provide the desired flexibility and surface characteristics. It will also be appreciated that flexible particle board or laminates of synthetic resin and paper, or fiber filled structures, may be employed if so desired. Most conveniently, the several elements of the container members are fabricated from the same synthetic resin so that solvent bonding may be readily employed. Again, ABS interpolymer has proven highly advantageous for this application, but other polymers may be employed if so desired.

The dome element 14 is conveniently thermoformed or molded from synthetic resin such as a clear acrylic (polymethyl methacrylate) or polycarbonate. The molding strips 54 are preferably of an extruded polyvinyl resin providing some degree of flexibility. The back support member 48, since it is not exposed, may be economically fabricated from a cardboard-type material although synthetic resin sheet material may also be employed if so desired. Depending upon the application, the back cover sheet 68 may be of plywood or particle board which may or may not have a laminated resin surface, or it may be a synthetic resin sheet material of the same type as employed for the front cover sheet 10.

From the foregoing detailed specification and the attached drawings, it can be seen that the novel display and storage assembly of the present invention is one in which tubular containers are mounted securely and in a facile manner. The several components of the assembly may be economically fabricated and readily interengaged to provide an attractive, relatively rugged and relatively durable display assembly. Synthetic resin sheet materials and molded elements may be utilized to facilitate assembly and to provide highly attractive components, and they in turn may be adhesively interengaged to enhance the strength of the overall assembly.

Having thus described the invention, I claim:

1. In a display and storage assembly, the combination comprising:

A. a plurality of body members vertically spaced apart and each having an arcuate edge surface;

B. a flexible sheet material cover member extending in an arcuate configuration about the arcuate edge surfaces of said body members and having a multiplicity of apertures spaced thereabout;

C. means securing said cover member to said body members;

D. a flexible sheet material back support member extending in an arcuate configuration spaced from said arcuate edges of said body members and said cover member, the arc of said support member being of lesser radius than that of said cover member to maintain substantially uniform spacing therebetween, said back support member being supported by said body members and having apertures therein aligned with the apertures of said cover member; and E. a multiplicity of container members extending between and supported in said apertures of said cover and back support members, said container members each having a tubular body element extending between the cover and back support members, a front rim element having a tubular body portion extending through an aperture of said cover member into telescoping engagement with said body element and a peripheral flange portion abutting the outer surface of said cover member, and a rear wall element on the inner end of said body element and having a portion projecting therefrom seated in the cooperating aperture of said back support member;

whereby said container members each define a storage compartment open through the apertures of said cover member for storage and display of goods.

2. The display and storage assembly in accordance with claim 1 wherein there is included a plurality of vertical members extending between said body members and means securing said body members and vertical members in assembly.

3. The display and storage assembly in accordance with claim 2 wherein two of said vertical members are disposed at the ends of said arcuate edge surface of said body members and wherein there are included vertically extending molding members enclosing the adjacent surfaces of said cover member and said vertical members.

4. The display and storage assembly in accordance with claim 3 wherein there are included a back sheet member extending across the surface of said body members between the ends of said arcuate edge surfaces thereof and of said cover member.

5. The display and storage assembly in accordance with claim 4 wherein said molding members are integrally formed to provide a plurality of recesses seating the edges of said cover member and said back sheet member.

6. The display and storage assembly in accordance with claim 1 wherein there are provided three spaced body members, with two body members being adjacent the upper and lower edges of said cover member and one body member being intermediate said first mentioned two body members, said apertures of said cover member being disposed in the portion thereof extending between the upper and intermediate body members, said back support member being disposed between said upper and intermediate support members.

7. The display and storage assembly in accordance with claim 1 wherein said container members are of circular cross section and wherein said apertures of said cover member are of cooperating circular configuration so as to snugly seat the body elements of said container members.

8. The display and storage assembly in accordance with claim 7 wherein said apertures in said back support member are coaxially aligned with said apertures of said cover member and wherein said projecting portions on said rear wall elements of said container members are coaxial bosses.

9. The display and storage assembly in accordance with claim 8 wherein there is included locking members engaging said projecting portions extending through said back support member to retain them in assembly therewith.

10. The display and storage assembly in accordance with claim 8 wherein said rear wall element includes a cylindrical body portion telescopically engaged with said body element of said container member and an end wall portion.

11. The display and storage assembly in accordance with claim 10 wherein said front rim element and said rear wall element are adhesively engaged with said body element.

12. The display and storage assembly in accordance with claim 1 wherein said rim elements of said container members are adhesively engaged with the front surface of said cover member.

13. The display and storage assembly in accordance with claim 1 wherein there are included a cap member having the configuration of a segment of a sphere and disposed above said cover member and the uppermost of said body members and means securing said cap member in assembly with the uppermost body member.

14. In a method of making a display and storage assembly, the steps comprising:

A. assembling in vertically spaced relationship a plurality of horizontally extending support members each having an aligned arcuate edge and thereby forming a frame;

B. forming a multiplicity of apertures in a length of self-supporting flexible sheet material;

C. securing in said apertures of said length of flexible sheet material rim elements each having a tubular body portion extending through said apertures and projecting therebeyond and a peripheral flange portion abutting the one surface of said length of flexible sheet material;

D. forming said length of flexible sheet material about the arcuate edge of said frame of vertically spaced support members to provide an arcuate front cover with said flange portions of said rim elements disposed on the outer surface thereof;

E. securing said front cover to said frame in said arcuate configuration;

F. engaging tubular body elements on the inwardly projecting body portions of said rim elements to form tubular container members;

G. forming into a cooperating arcuate configuration a second length of flexible sheet material having apertures therein aligned with said apertures of said front cover and said container members while inserting into said apertures of said second length projections on the inner ends of said container members; and H. securing said second length of sheet material in said arcuate configuration.

15. The method of making a display and storage assembly in accordance with claim 14 wherein the step of securing said rim elements to said front cover includes effecting adhesive engagement between at least the flange portions thereof and the outer surface of said front cover.

16. The method of making a display and storage assembly in accordance with claim 14 wherein the step of engaging tubular body elements on the body portions of said rim elements includes effecting adhesive engagement between telescoping portions of said body portions and said body elements.

17. The method of making a display and storage assembly in accordance with claim 14 wherein there is included the step of applying locking elements on the projecting portions at the inner ends of said container members extending through said apertures in said second length of said flexible material.

18. The method of making a display and storage assembly in accordance with claim 14 wherein there is included the step of applying vertically extending molding to the side edges of said front cover sheet, bending said front cover sheet about said frame and securing said molding members to said frame.

19. The method of making a display and storage assembly in accordance with claim 14 wherein there is included the step of applying across the back surface of said frame a back cover panel.

* * * * *